US010828669B2

(12) United States Patent
Liu

(10) Patent No.: US 10,828,669 B2
(45) Date of Patent: Nov. 10, 2020

(54) METHOD AND APPARATUS FOR SEALING SOLID WOOD FLOOR WITH WAX AND SOLID WOOD FLOOR

(71) Applicant: Zhejiang Lingge Wood Co., Ltd., Zhejiang (CN)

(72) Inventor: Binbin Liu, Zhejiang (CN)

(73) Assignee: Zhejiang Lingge Wood Co., Ltd., Zhejiang (CN)

( * ) Notice: Subject to any disclaimer, the term of this patent is extended or adjusted under 35 U.S.C. 154(b) by 173 days.

(21) Appl. No.: 15/976,236

(22) Filed: May 10, 2018

(65) Prior Publication Data

US 2019/0105685 A1 Apr. 11, 2019

(30) Foreign Application Priority Data

Oct. 9, 2017 (CN) ..... 2017 1 0929172

(51) Int. Cl.
*B05D 1/02* (2006.01)
*B05D 7/06* (2006.01)
(Continued)

(52) U.S. Cl.
CPC ..... *B05D 7/06* (2013.01); *B05B 1/14* (2013.01); *B05D 1/02* (2013.01); *B05D 7/54* (2013.01); *E04F 15/04* (2013.01)

(58) Field of Classification Search
CPC .... B05B 1/14; B05D 1/02; B05D 7/06; B05D 7/54; E04F 15/04
See application file for complete search history.

(56) References Cited

U.S. PATENT DOCUMENTS 3,852,095 A * 12/1974 Hogstrom ..... B05B 13/0242 427/284
2001/0034991 A1* 11/2001 Martensson ..... E04B 1/6129 52/578

(Continued)

FOREIGN PATENT DOCUMENTS

| | | | |
|---|---|---|---|
| CN | 2801950 | Y | 8/2006 |
| DE | 102015219102 | A1 | 4/2017 |
| WO | 2012001510 | A2 | 1/2012 |

OTHER PUBLICATIONS

Extended European Search Report dated Dec. 21, 2018 for European application No. 18177933.1.

*Primary Examiner* — Alexander M Weddle
(74) *Attorney, Agent, or Firm* — Ohlandt, Greeley, Ruggiero and Perle, LLP

(57) ABSTRACT

A method and an apparatus for sealing a solid wood floor with wax and a solid wood floor are provided. The method includes: providing a solid wood floor, where the solid wood floor has two end surfaces defining boundaries of a length dimension of the solid wood floor; and spraying at least one of the two end surfaces with wax. When the wax is sprayed on the at least one end surface, a portion of the wax penetrates into the pores and becomes solidified to seal the pores, and another portion of the wax adheres to the at least one end surface and becomes solidified to form a wax film on the at least one end surface. Therefore, external moisture can be prevented from entering an interior of the solid wood floor; external dust, water, etc. can be prevented from entering between two solid wood floors paved adjacently.

6 Claims, 5 Drawing Sheets

(51) Int. Cl.

| | |
|---|---|
| ***E04F 15/04*** | (2006.01) |
| ***B05B 1/14*** | (2006.01) |
| ***B05D 7/00*** | (2006.01) |

(56) References Cited

U.S. PATENT DOCUMENTS

| | | | | |
|---|---|---|---|---|
| 2003/0003258 | A1* | 1/2003 | Durso | B29C 65/522 428/53 |
| 2006/0037270 | A1* | 2/2006 | Niese | E04F 15/04 52/578 |
| 2006/0073320 | A1* | 4/2006 | Pervan | B05C 1/08 428/292.4 |
| 2012/0151732 | A1 | 6/2012 | LaForest | |
| 2018/0290173 | A1 | 10/2018 | Homeier | |

* cited by examiner

METHOD AND APPARATUS FOR SEALING SOLID WOOD FLOOR WITH WAX AND SOLID WOOD FLOOR

CROSS-REFERENCE TO RELATED APPLICATIONS

This application claims the benefit of priority to Chinese Patent Application No. 201710929172.0, titled "METHOD AND APPARATUS FOR SEALING SOLID WOOD FLOOR WITH WAX AND SOLID WOOD FLOOR", filed on Oct. 9, 2017, the entire disclosure of which is incorporated herein by reference.

TECHNICAL FIELD

The present disclosure relates to home decoration field, and more particularly, to a method and an apparatus for sealing a solid wood floor with wax and a solid wood floor.

BACKGROUND

Solid wood floor is a ground decoration material formed by drying and processing natural wood. The solid wood floor is natural in texture and is safe to use because it is processed directly from solid wood. The solid wood floor has become an ideal material of ground decoration in bedrooms, living rooms and study rooms etc. However, after being laid on a ground, the solid wood floor usually has a short service life, which reduces customer experience and causes customer complaints. Therefore, how to improve the service life of solid wood floor becomes a technical problem that urgently needs to be solved in the prior art.

SUMMARY

In order to improve a service life of the solid wood and customer experience and to avoid customer complaints, a method for sealing a solid wood floor with wax is provided according to embodiments of the present disclosure, including: providing a solid wood floor, where the solid wood floor has two end surfaces defining boundaries of a length dimension of the solid wood floor; and spraying at least one of the two end surfaces with wax.

In some embodiment, spraying the at least one end surface with wax may include spraying the at least one end surface with wax at least twice.

In some embodiment, spraying at least one of the two end surfaces with wax includes forming a wax film having a thickness ranging from 0.1 mm to 0.2 mm on the at least one end surface.

In some embodiment, a temperature of the wax ranges from 90° C. to 110° C.

In some embodiment, the method further includes forming a paint film on the at least one end surface before spraying the at least one end surface with wax.

In some embodiment, the wax belongs to one of a natural wax, a water-based wax and a solid wax.

In some embodiment, spraying at least one of the two end surfaces with wax includes spraying the two end surfaces with wax.

A solid wood floor is also provided according to embodiments, including: two end surfaces defining boundaries of a length dimension of the solid wood floor, wherein a wax film is formed on at least one of the two end surfaces.

In some embodiment, the wax film has a thickness ranging from 0.1 mm to 0.2 mm.

In some embodiment, a paint film is formed on the at least one end surface, and the wax film covers the paint film.

An apparatus for sealing a solid wood floor with wax is also provided, including: a conveying device, including at least one slide rail and a conveying member disposed on the at least one slide rail, where the conveying member is configured to carry a solid wood floor and to convey the solid wood floor along an extending direction of the at least one slide rail; and a wax sealing device, including a wax storage box and at least one wax spraying part communicated with the wax storage box, where the at least one wax spraying part is fixedly disposed on the at least one slide rail and configured to spray wax on at least one end surface of the solid wood floor, and the at least one end surface defines at least one boundary of a length dimension of the solid wood floor.

In some embodiment, each of the at least one wax spraying part is provided with at least two wax outlets along an extending direction of the at least one slide rail.

In some embodiment, each of the at least one wax spraying part is further provided with a reflux inlet configured to recycle the wax sprayed from the at least two wax outlets.

In some embodiment, the reflux inlet is disposed between two adjacent wax outlets of the at least two wax outlets.

In some embodiment, each of the at least one wax spraying part includes a flange portion extending outward, the flange portion is disposed opposite to the conveying member in a direction perpendicular to the at least one slide rail, and the at least two wax outlets are disposed between the conveying member and the flange portion.

In some embodiment, the conveying device further includes at least one roller rotatably disposed on the at least one slide rail, and the at least one roller is disposed opposite to the conveying member in a vertical direction perpendicular to the at least one slide rail and is configured to press against the solid wood floor.

In some embodiment, the conveying member includes at least one conveyor belt disposed along the extending direction of the at least one slide rail.

In some embodiment, the at least one slide rail includes a first slide rail and a second slide rail arranged in parallel, the at least one conveyor belt includes a first conveyor belt disposed on the first slide rail and a second conveyor belt disposed on the second slide rail, the at least one wax spraying part includes a first wax spraying part fixedly disposed on the first slide rail and a second wax spraying part fixedly disposed on the second slide rail, and the first wax spraying part is disposed opposite to the second wax spraying part.

In some embodiment, a distance between the first slide rail and the second slide rail is adjustable.

In some embodiment, the conveying device further includes a slide rod disposed perpendicularly to the first slide rail and the second slide rail; and at least one of the first slide rail and the second slide rail is provided with a slider, the slider is configured to slide along the slide rod, so as to change the distance between the first slide rail and the second slide rail.

In some embodiment, the conveying device further includes a feeding bin, and the feeding bin is fixedly disposed at one axial end of the at least one slide rail.

Comparing with the prior art, the present disclosure has the following advantages.

In the method for sealing a solid wood floor with wax, the wax is sprayed on the at least one end surface of the solid wood floor, where the at least one end surface defines at least one boundary of a length dimension of the solid wood floor, so that a portion of the wax can penetrate into pores of the solid wood floor and become solidified to seal the pores, another portion of the wax can be solidified on the at least one end surface to form a wax film. Therefore, external moisture can be prevented from entering an interior of the solid wood floor to prevent the solid wood floor from getting damped and deformed, a service life of the solid wood floor can be extended, and customer satisfaction can be improved; external dust, water, etc. can be prevented from entering between two solid wood floors paved adjacently; an overall appearance of the laid solid wood floors will not be affected after the floor is sealed with wax; when the laid solid wood floors are subjected to force, no noise will be emitted due to a relative slide between two adjacent solid wood floors, thereby further improving customer satisfaction.

DETAILED DESCRIPTION

In order to make the above-mentioned objects, features, and advantages of the present invention more apparent, the specific embodiments of the present disclosure will be described in detail below with reference to the accompanying drawings.

Figure 1:
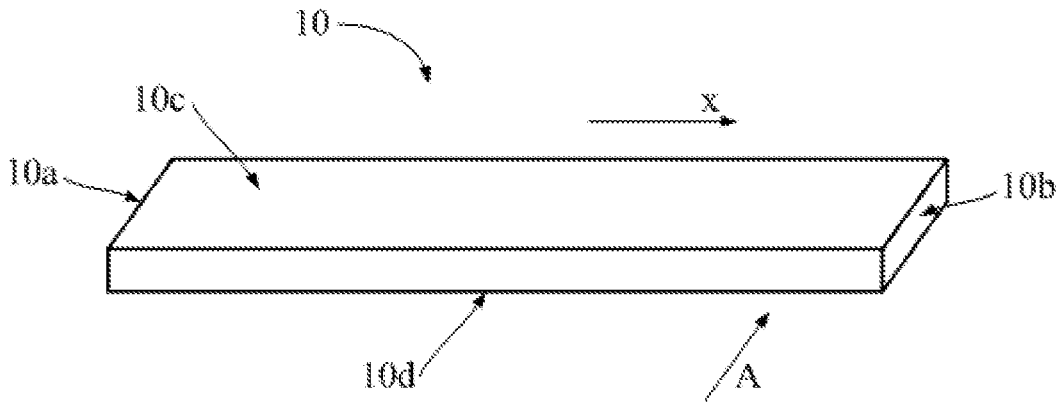
FIG. 1 schematically illustrates a stereogram of a solid wood floor 10 according to an embodiment.
Figure 2:
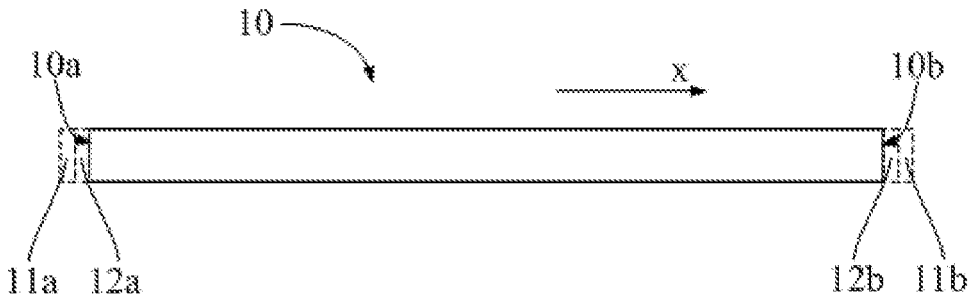
FIG. 2 schematically illustrates a structural diagram of the solid wood floor 10 along a direction A shown in FIG. 1.

Referring to FIGS. 1 and 2, FIG. 1 schematically illustrates a stereogram of a solid wood floor 10 according to an embodiment, FIG. 2 schematically illustrates a structural diagram of the solid wood floor 10 along a direction A shown in FIG. 1, the solid wood floor 10 may have an elongated shape with a front surface 10*c*, a back surface 10*d*, a first end surface 10*a* and a second end surface 10*b*, where the first end surface 10*a* and the second end surface 10*b* define boundaries of a length dimension of the solid wood floor 10. Specifically, each of the first end surface 10*a* and the second end surface 10*b* may be perpendicular to a length direction x as shown in FIGS. 1 and 2. When the solid wood floor 10 is laid on a ground, the front surface 10*c* is exposed outside, the back surface 10*d* faces the ground, and the first end surface 10*a* and the second end surface 10*b* of two adjacent solid wood floors 10 fit together to ensure flatness of the floor.

Since the first end surface 10*a* and the second end surface 10*b* of the solid wood floor 10 will not be exposed outside when the solid wood floor 10 is laid on the ground, an overall appearance of the solid wood floor 10 will not be affected. In the prior art, the first end surface 10*a* and the second end surface 10*b* are usually not processed by manufacturers in order to improve production efficiency and to reduce production cost.

The inventors found that, a solid wood floor tends to have a short service life if being directly laid on a ground with the first end surface 10*a* and second end surface 10*b* unprocessed. Generally, the solid wood floor will be deformed by moisture after a few years, resulting in change in an overall structure of the solid wood floor and affecting a service life of the solid wood floor, which may further reduce the customer experience and cause customer complaints.

Further investigation shows that the solid wood floor is made of a natural wood, and the natural wood has pores allowing sap to flow. When the natural wood is processed into a solid wood floor, pores still exist in the solid wood floor and allow external moisture to enter the solid wood floor. As a result, the solid wood floor may be easily damped and deformed, and an overall structure of the laid solid wood floor may be affected.

In addition, the length direction x of the solid wood floor 10 is generally a direction in which the sap flows, since the sap is delivered between a root and a top of a tree. That is, more pores may be distributed on the first end surface 10*a* and the second end surface 10*b*, and it is much easier for external moisture to enter an interior of the solid wood floor 10 through the first end surface 10*a* and the second end surface 10*b*, resulting in dampness and deformation of the solid wood floor 10.

In addition, if the first end surface 10*a* and the second end surface 10*b* of two adjacent solid wood floors 10 are directly contacted and jointed, a gap may generate between the first end surface 10*a* and the second end surface 10*b* due to manufacturing tolerance or the like, and then dust, water, etc. may easily enter the gap and an overall appearance of the laid solid wood floors 10 may be affected.

Further, since the first end surface 10*a* and the second end surface 10*b* are in contact with each other, when the solid wood floors 10 are subjected to a force, for example, when a man walks on the laid solid wood floors 10, there may be noise emitted due to a relative sliding between the first side surface 10*a* and the second side surface 10*b*, which may reduce customer experience and cause customer complaints.

Therefore, a method for sealing a solid wood floor with wax is provided according to embodiments.

Before the solid wood floor 10 is laid on a ground, at least one of the first end surface 10*a* and the second end surface 10*b* of the solid wood floor 10 is sprayed with wax. Specifically, the wax may be a liquid wax. When the liquid wax is sprayed on the at least one end surface, a portion of the liquid wax may penetrate into the pores and become solidified to block the pores, and another portion of the liquid wax may be solidified on the at least one end surface and form a wax film on the at least one end surface.

Firstly, both the wax penetrating into the pores and the wax forming a wax film on the at least one end surface can prevent external moisture from entering an interior of the solid wood floor 10. Therefore, dampness and deformation of the solid wood floor 10 can be prevented, a service life of the solid wood floor 10 can be extended and customer satisfaction can be improved.

Secondly, the wax film formed on at least one of the first end surface 10*a* and the second end surface 10*b* can fill the gap between two adjacent solid wood floors 10. Therefore, external dust, water, etc. can be prevented from entering between two adjacent solid wood floors 10 and thus the overall appearance of the laid solid wood floors 10 will not be affected.

Thirdly, the wax film also has functions of lubrication and mute. When the laid solid wood floors are subjected to force, even if a relative slide occurs to the first end surface 10*a* and the second end surface 10*b* of two adjacent solid wood floors, no noise will be emitted, thereby further improving customer experience.

Specifically, before the solid wood floor 10 is laid on a ground, both the first end surface 10*a* and the second end surface 10*b* of the solid wood floor 10 may be sprayed with wax. As shown in FIG. 2, a first wax film 11*a* may be formed on the first end surface 10*a*, and a second wax film 11*b* may be formed on the second end surface 10*b*, so as to achieve a better moisture-proof and mute effect.

In order to better seal the pores of the solid wood floor 10, and to better play a moisture-proof and mute effect, the first end surface 10*a* may be sealed with wax in a manner as described below.

In some embodiment, a first paint film 12*a* may be sprayed on the first end surface 10*a* before the wax is sprayed on the first end surface 10*a*. The first paint film 12*a* can block and seal the pores on the first end surface 10*a* to a certain extent and prevent external moisture from entering the solid wood floor 10 via the first end surface 10*a*, so as to prevent the solid wood floor 10 from getting damped.

Specifically, the first end surface 10*a* may be sprayed with the first paint film 12*a* for a plurality of times to better seal the pores. However, research shows that the pores on the first end surface 10*a* cannot be sealed by merely spraying the first paint film 12*a* on the first end surface 10*a*.

In some embodiment, a temperature of the wax applied to be sprayed on the first end surface 10*a* may range from 90° C. to 110° C. Wax generally starts to melt at a temperature between 50° C. and 70° C., and completely melts into a liquid at a temperature above 80° C. When the temperature of the wax is below 90° C., the liquid wax is viscous and unsuitable for spraying; when the temperature of the wax is above 110° C., the liquid wax cannot be quickly solidified after being sprayed on the first end surface 10*a*, and thus it is not easy to form a uniform first wax film 11*a* on the first end surface 10*a*.

Specifically, the wax may belong to one of a natural wax, a water-based wax and a solid wax.

Figure 3:
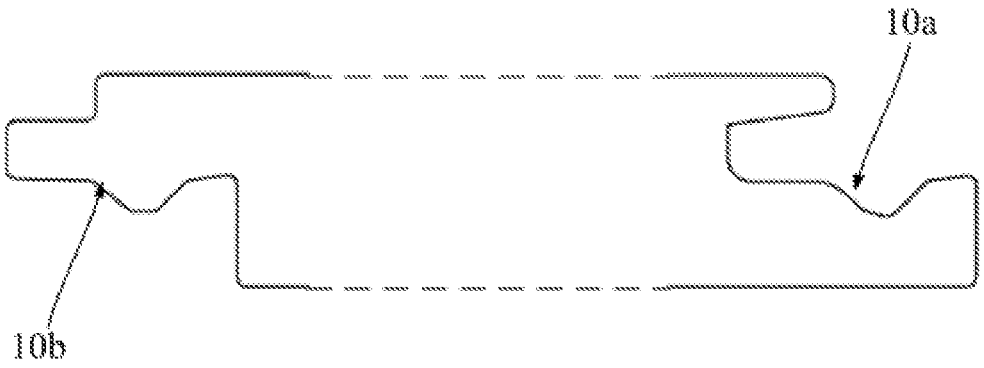
FIG. 3 and FIG. 4 schematically illustrate side views of the solid wood floor 10 shown in FIG. 1 with two different locking mechanisms between adjacent end surfaces 10*a* and 10*b;*
Figure 4:
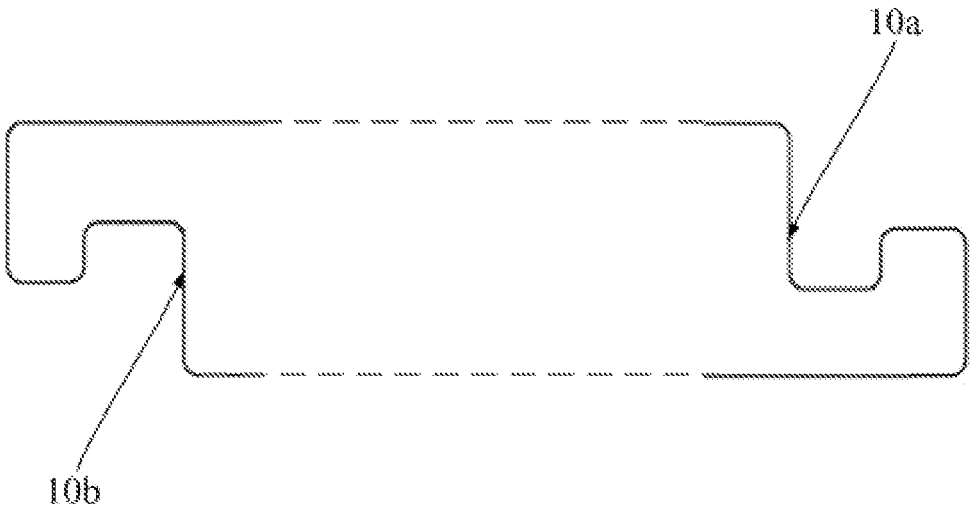

It should be noted that, the first end surface 10*a* and the second end surface 10*b* of the solid wood floor 10 in the present disclosure may be in various shapes and may have various structures. For example, the first side surface 10*a* and the second side surface 10*b* may both have a planar structure, or may respectively have a structure of tongue and a structure of groove or vice versa as shown in FIG. 3, or may respectively have a structure of male buckle and a structure of female buckle as shown in FIG. 4. For the latter two kinds of locking mechanisms, the structure of the first end surface 10*a* is too complex, and it may be difficult to seal all area of the first end surface 10*a* with wax by merely spraying the first end surface 10*a* once, then external moisture cannot be effectively prevented from entering an interior of the solid wood floor 10.

Therefore, in some embodiment, the first end surface 10*a* may be sprayed with wax at least twice, and each time a direction in which the wax is sprayed may be different. Specifically, the first end surface 10*a* may be sprayed with wax at multiple angles based on a specific shape of the first end surface 10*a*, so that the wax film can cover the first end surface 10*a* fully, then the external moisture can be effectively prevented from entering the solid wood floor 10 and the solid wood floor can be prevented from getting deformed.

In some embodiment, spraying wax to the first end surface 10*a* may include forming a first wax film 11*a* having a thickness ranging from 0.1 mm to 0.2 mm on the first end surface 10*a*. If the first wax film 11*a* is too thick, not only an overall appearance of the solid wood floor 10 may be affected, but also the first wax film 11*a* may be prone to falling off from the first end surface 10*a*.

If the first wax film 11*a* is too thin, the first wax film 11*a* may fail to cover all area of the first end surface 10*a*, and pores cannot be effectively sealed; gaps may generate between two adjacent solid wood floors laid on the ground, thereby affecting the overall appearance of the solid wood floors; furthermore, when the solid wood floors are subjected to force, there may be noise emitted due to a relative sliding between the two adjacent solid wood floors.

In some embodiment, the method for sealing the second end surface 10*b* with wax may refer to the method for sealing the first end surface 10*a* with wax, which will not be described in detail herein.

In other embodiments, depending on the requirements in practice, the method for sealing a solid wood floor with wax may include sealing two side surfaces of the solid wood floor 10 with wax, where the two side surfaces define boundaries of a width dimension of the solid wood floor 10, and the specific method for sealing the two side surfaces with wax may also refer to the method for sealing the first end surface 10*a* with wax, which will not be described in detail herein.

With continued reference to FIG. 1 and FIG. 2, a solid wood floor 10 is also provided according to embodiments, the solid wood floor 10 may have a front surface 10*c*, a back surface 10*d* opposite to the front surface 10*c*, a first end surface 10*a* and a second end surface 10*b*, where the front surface 10*c* is exposed outside when the solid wood floor 10 is laid on a ground, the first end surface 10*a* and the second end surface 10*b* define boundaries of a length dimension of the solid wood floor 10. Specifically, the first end surface 10*a* and the second end surface 10*b* may be perpendicular to the length direction x as shown in FIG. 1 and FIG. 2.

In some embodiment, a first paint film 12*a* and a first wax film 11*a* may be sprayed on the first end surface 10*a*, where the first wax film 11*a* may cover the first paint film 12*a*. Specifically, the first wax film 11*a* may have a thickness ranging from 0.1 mm to 0.2 mm.

In some embodiment, a second paint film 12*b* and a second wax film 11*b* may be sprayed on the second end surface 10*b*, and the second wax film 11*b* may cover the second paint film 12*b*. Specifically, the second wax film 11*b* may have a thickness ranging from 0.1 mm to 0.2 mm.

Figure 5:
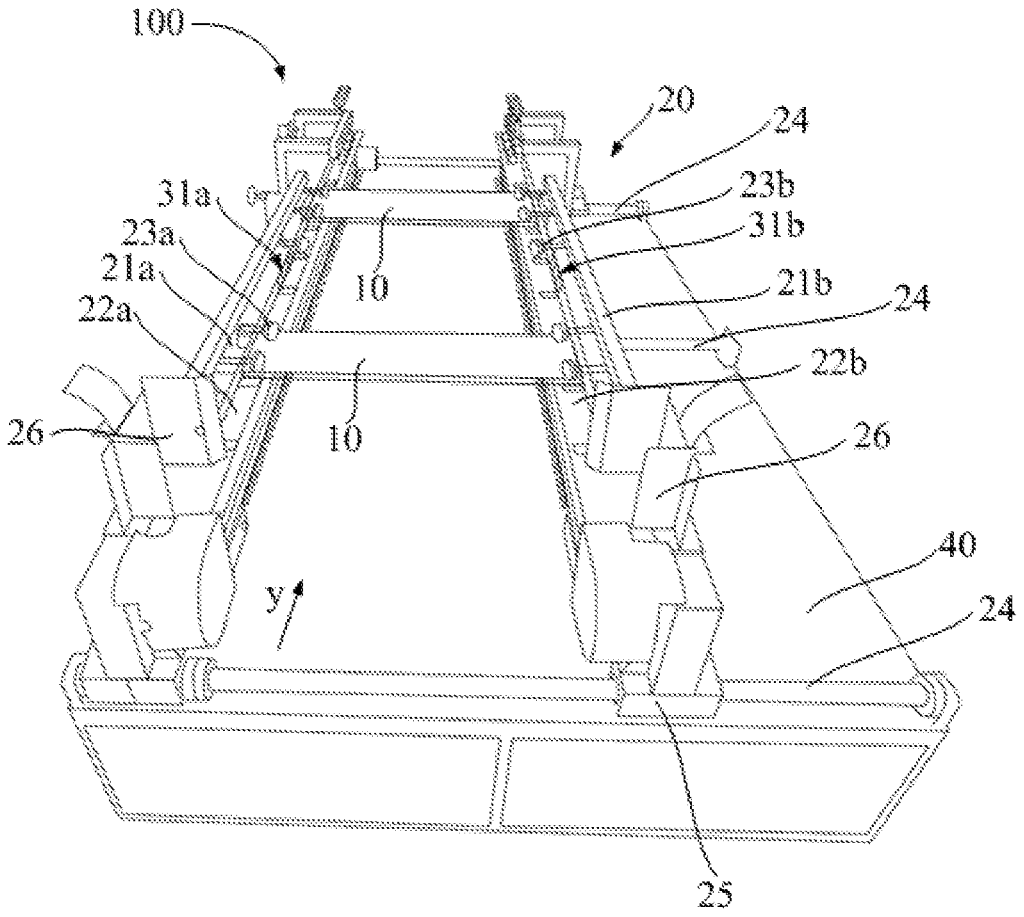
FIG. 5 schematically illustrates a stereogram of an apparatus 100 for sealing a solid wood floor with wax according to an embodiment.

Referring to FIG. 5, an apparatus 100 for sealing a solid wood floor with wax is also provided according to embodiments. The apparatus 100 may include a conveying device 20 and a wax sealing device, where the conveying device 20 may be fixedly disposed on a support platform 40 and may include at least one slide rail and a conveying member, the conveying member may be disposed on the at least one slide rail and may be configured to carry a solid wood floor and to convey the solid wood floor along an extending direction of the at least one slide rail.

Specifically, the at least one slide rail may include a first slide rail 21*a* and a second slide rail 21*b* arranged in parallel, the conveying member may be at least one conveyor belt, and the at least one conveyor belt may include a first conveyor belt 22*a* and a second conveyor belt 22*b* arranged in parallel. The first conveyor belt 22*a* may be disposed on the first slide rail 21*a* and may extend along an extending direction of the first slide rail 21*a* (i.e. the y-direction as shown in FIG. 5), and the second conveyor belt 22*b* may be disposed on the second slide rail 21*b* and may extend along an extending direction of the second slide rail 21*b* (i.e. the extending direction of the first slide rail 21*a*, or the y-direction shown in FIG. 5).

In some embodiment, the wax sealing device may include a wax storage box (not shown) and at least one wax spraying part communicated with the wax storage box, where a liquid wax may be stored in the wax storage box, and the liquid wax may be sprayed out through the at least one wax spraying part. Specifically, the at least one wax spraying part may include a first wax spraying part 31*a* fixedly disposed on the first slide rail 21*a* and a second wax spraying part 31*b* fixedly disposed on the second slide rail 21*b*, and the first wax spraying part 31*a* and the second wax spraying part 31*b* may be disposed opposite to each other.

Figure 6:
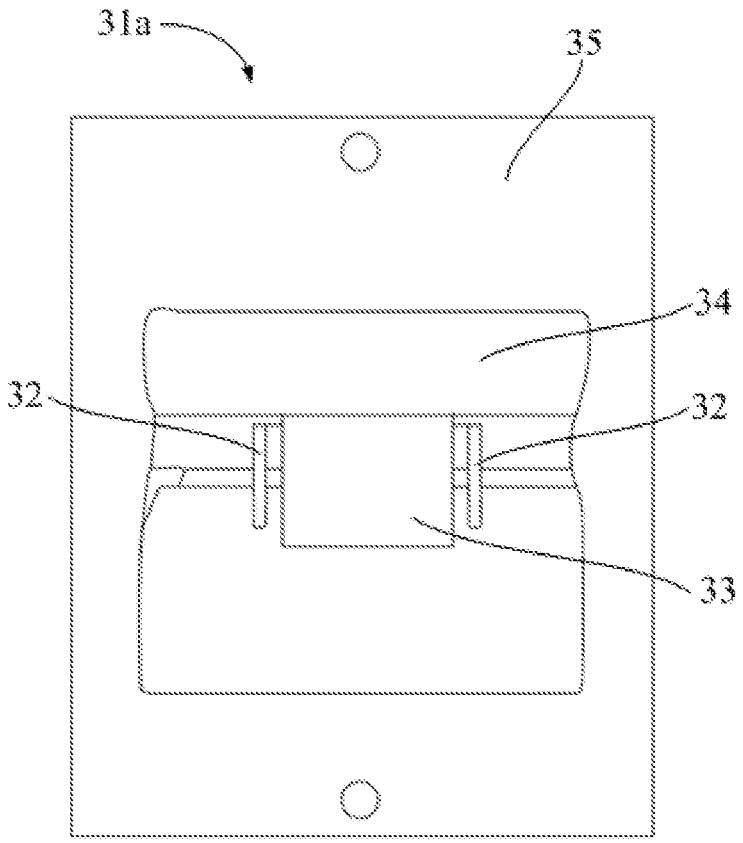
FIG. 6 schematically illustrates a structural diagram of a first wax spraying part 31*a* of the apparatus 100 for sealing a solid wood floor with wax shown in FIG. 5.

Referring to FIG. 6, FIG. 6 schematically illustrates a structural diagram of the first wax spraying part 31*a*. In some embodiment, the first wax spraying part 31*a* may include a fixing portion 35 configured to fix the first wax spraying part 31*a* to the first slide rail 21*a*. The first wax spraying part 31*a* may further have at least one wax outlet 32, where the at least one wax outlet 32 may face the second wax spraying part 31*b* when the first wax spraying part 31*a* is fixed to the first slide rail 21*a*. The specific structure of the second wax spraying part 31*b* may refer to the structure of the first wax spraying part 31*a*, and at least one wax outlet of the second wax spraying part 31*b* may face the first wax spraying part 31*a* when the second wax spraying part 31*b* is fixed to the second slide rail 21*b*.

When the solid wood floor 10 is placed on the first conveyor belt 22*a* and the second conveyor belt 22*b*, the first conveyor belt 22*a* and the second conveyor belt 22*b* can carry the solid wood floor 10 to move in the y-direction. When the solid wood floor 10 is moved between the first wax spraying part 31*a* and the second wax spraying part 31*b*, the first wax spraying part 31*a* and the second wax spraying part 31*b* may respectively spray wax on the first end surface 10*a* and the second end surface 20*b* of the solid wood floor 10. The wax sprayed on the solid wood floor 10 forms a wax film and the wax film can seal the pores on the solid wood floor 10 so as to prevent external moisture from entering an interior of the solid wood floor 10 and to prevent the solid wood floor 10 from getting deformed by moisture. Therefore, a service life of the solid wood floor 10 can be extended and customer satisfaction can be improved.

In other embodiments, the conveying member may also be at least one roller, the solid wood floor may be disposed on the at least one roller and be driven to move in the y-direction by rotation of the at least one roller.

As shown in FIG. 6, the first wax spraying part 31*a* may be provided with two wax outlets 32, and when the first wax spraying part 31*a* is fixedly disposed on the first slide rail 21*a*, the two wax outlets 32 may be arranged in the y-direction in sequence. By providing the two wax outlets 32, the first end surface 10*a* can be sprayed with wax at least twice, so that the pores can be better sealed to prevent external moisture from entering the solid wood floor.

Opening orientations of the two wax outlets 32 may depend on a specific shape of the first end surface 10*a*, so that the two wax outlets 32 can spray wax on the first end surface 10*a* at different angles, the first end surface 10*a* can be better covered with the wax film, and external moisture can be more effectively prevented from entering the solid wood floor.

In some embodiments, the first wax spraying part 31*a* may also be provided with more than three wax outlets, and the plurality of wax outlets may respectively have different orientations, so that the first end surface 10*a* can be sprayed with wax at multiple angles and the first end surface 10*a* can be better sealed with the wax film.

With continued reference to FIG. 6, the first wax spraying part 31*a* may further has a reflux inlet 33 configured to recycle the wax sprayed from the at least one wax outlet 32, the wax sprayed from the at least one wax outlet 32 may be a liquid wax with a temperature ranging from 90° C. to 110° C. When the liquid wax is sprayed out from the at least one wax outlet 32, a portion of the liquid wax may adhere to the first end surface 10*a* and become solidified to form the first wax film 11*a*, another portion of the liquid wax may be suspended in air and absorbed by the reflux inlet 33 for recycling. Therefore, materials can be saved and production efficiency can be improved; besides, the liquid wax can be prevented from falling onto a work surface to keep the work surface clean.

Specifically, an interior of the reflux inlet 33 may be a low-pressure region, so that air and the liquid wax in an outer peripheral region of the reflux inlet 33 can be sucked into the reflux inlet 33. In some embodiment, the reflux inlet 33 may be disposed between two wax outlets 32 so that the liquid wax can be absorbed to a large extent to avoid material waste. In some embodiment, a plurality of reflux inlets 33 may be disposed on the first wax spraying part 31*a* so as to better absorb the liquid wax, and further to save materials, to reduce production costs and to improve production efficiency.

In some embodiments, the first wax spraying part 31*a* may further include a flange portion 34 extending outward. When the first wax spraying part 31*a* is fixedly disposed on the first slide rail 21*a*, the flange portion 34 may be disposed opposite to the first conveyor belt 22*a* in a direction perpendicular to the first slide rail 21*a* (i.e. perpendicular to the y-direction), and the at least one wax outlet 32 may be disposed between the first conveyor belt 22*a* and the flange portion 34.

When the liquid wax is sprayed out from the at least one wax outlet 32, the liquid wax will not spread to a large area in an environment due to blocking of the flange portion 34 and the first conveyor belt 22*a*, and thus environmental pollution can be avoided to a large extent; on the other hand, since the liquid wax is confined within a certain area, it is more beneficial for the liquid wax to be recycled by the reflux inlet 33, thereby effectively saving materials and improving production efficiency.

In some embodiment, structures and arrangements of the at least one wax outlet, the reflux inlet, and the flange portion in the second wax spraying part 31*b* may refer to those counterparts in the first wax spraying part 31*a*, which will not be described in detail herein.

With continued reference to FIG. 5, in some embodiment, the conveying device 20 may further include at least one roller fixedly disposed on the at least one slide rail. Specifically, the at least one roller may include at least one first roller 23*a* fixedly disposed on the first slide rail 21*a*, and at least one second roller 23*b* fixedly disposed on the second slide rail 21*b*.

The at least one first roller 23*a* may be disposed opposite to the first conveyor belt 22*a* in a direction perpendicular to the first slide rail 21*a* (i.e. perpendicular to the y-direction), and the at least one second roller 23*b* may be disposed opposite to the second conveyor belt 22*b* in a direction perpendicular to the second slide rail 21*b* (i.e. perpendicular to the y-direction).

When the solid wood floor 10 is placed on the first conveyor belt 22*a* and the second conveyor belt 22*b*, the solid wood floor 10 may move in the y-direction along with the movements of the first conveyor belt 22*a* and the second conveyor belt 22*b*; the at least one first roller 23*a* and the at least one second roller 23*b* are configured to press against the solid wood floor 10 to limit the solid wood floor 10 between the conveyor belts and the rollers, so that the solid wood floor 10 can be prevented from jumping in a vertical direction perpendicular to the y-direction and can move more stably in the y-direction.

When the solid wood floor 10 is moved in the y-direction, the at least one first roller 23*a* and the at least one second roller 23*b* in contact with the solid wood floor 10 can rotate with the movement of the solid wood floor 10, and thus no sliding friction will be generated between the at least one first roller 23*a* and the solid wood floor 10 or between the at least one second roller 23*b* and the solid wood floor 10. Therefore, the movement of the solid wood floor 10 in the y-direction will not be hindered to a large extent.

Specifically, there may be a plurality of the first rollers 23*a* disposed along the y-direction in sequence and a plurality of the second rollers 23*b* disposed along the y-direction in sequence.

In some embodiment, a distance between the first slide rail 21*a* and the second slide rail 21*b* may be adjustable.

Specifically, the conveying device 20 may further include a slide rod 24 perpendicular to the first slide rail 21*a* and the second slide rail 21*b*, where the slide rod 24 may be fixedly disposed on a support platform 40, the first slide rail 21*a* may be fixedly disposed on the support platform 40 and may be disposed at one end of the slide rod 24. A slider 25 may be fixedly disposed on the second slide rail 21*b*, and the slider 25 may be meshed with the slide rod 24 and may be configured to move along the slide rod 24 so as to adjust the distance between the first slide rail 21*a* and the second slide rail 21*b*.

A distance between the first conveyor belt 22*a* and the second conveyor belt 22*b* may be adjusted by adjusting the distance between the first slide rail 21*a* and the second slide rail 21*b*, so that the conveying device 20 can be adapted to the solid wood floors 10 having different lengths. Therefore, the apparatus 100 for sealing a solid wood floor with wax will become more widely applied.

It should be noted that, in other embodiments, a slider may be disposed on the first slide rail 21*a* and configured to slide along the slide rod 24, so as to change the distance between the first slide rail 21*a* and the second slide rail 21*b*.

With continued reference to FIG. 5, the conveying device 20 may further include a feeding bin 26, where the feeding bin 26 may be fixedly disposed at one axial end of the first slide rail 21*a* and the second slide rail 21*b* and may be configured to receive a plurality of solid wood floors 10. When the apparatus 100 for sealing a solid wood floor with wax is in operation, the plurality of solid wood floors 10 in the feeding bin 26 can be continuously carried away by the first conveyor belt 21*a* and the second conveyor belt 21*b* and be sealed with wax. Therefore, it is not necessary for workers to keep adding solid wood floors, and labor costs can be reduced.

In some embodiment, the apparatus 100 for sealing a solid wood floor with wax may work in a manner described as below.

A distance between the first slide rail 21*a* and the second slide rail 21*b* may be adjusted by moving the slider 25 along the slide rod 24 based on a specific length of the solid wood floor 10, so that the first conveyor belt 21*a* and the second conveyor belt 21*b* are configure to carry the solid wood floor 10.

A plurality of the solid wood floors 10 are placed in the feeding bin 26.

The apparatus 100 for sealing a solid wood floor with wax is started. The first conveyor belt 21*a* and the second conveyor belt 21*b* move in the y-direction, the solid wood floors 10 disposed in the feed bin 26 sequentially fall onto the first conveyor belt 21*a* and the second conveyor belt 21*b* and move in the y-direction with movement of the first conveyor belt 21*a* and the second conveyor belt 21*b*.

The at least one first roller 23*a* fixedly disposed on the first slide rail 21*a* and the at least one second roller 23*b* fixedly disposed on the second slide rail 21*b* limit the solid wood floors 10 between the conveyor belts and the rollers to prevent the solid wood floors 10 from jumping, so that the solid wood floors 10 can move more smoothly in the y-direction.

The first wax spraying part 31*a* and the second wax spraying part 31*b* are started, and the liquid wax is sprayed from the at least one wax outlet 32. If there is no solid wood floor between the first wax spraying part 31*a* and the second wax spraying part 31*b*, the liquid wax sprayed from the at least one wax outlet 32 may be recycled by the reflux inlet 33.

When a solid wood floor 10 is moved between the first wax spraying part 31*a* and the second wax spraying part 31*b*, a portion of the liquid wax sprayed from the at least one wax outlet 32 may adhere to the first end surface 10*a* and the second end surface 10*b* of the solid wood floor 10, another portion of the liquid wax may be recycled by the reflux inlet 33.

When the solid wood floor 10 moves away from the first wax spraying part 31*a* and the second wax spraying part 31*b*, a first wax film 11*a* may form on the first end surface 10*a* of the solid wood floor 10, and a second wax film 11*b* may form on the second end surface 10*b* of the solid wood floor 10. As such, the solid floors 10 may be sealed with wax by the apparatus 100.

Although the present disclosure is disclosed above, the present disclosure is not limited thereto. Any person skilled in the art can make various changes and modifications without departing from the spirit and scope of the present disclosure. Therefore, the protection scope of the present disclosure should be defined by the scope defined by the claims.

The invention claimed is:

1. A method for sealing a solid wood floor with wax, comprising:

providing a solid wood floor, wherein the solid wood floor has two end surfaces defining boundaries of a length dimension of the solid wood floor;

forming a paint film on at least one end surface of the two end surfaces;

spraying the at least one end surface of the two end surfaces with wax to cover the paint film.

2. The method for sealing a solid wood floor with wax according to claim 1, wherein spraying the at least one end surface with wax comprises: spraying the at least one end surface with wax at least twice.

3. The method for sealing a solid wood floor with wax according to claim 1, wherein spraying the at least one end surface with wax comprises: forming a wax film having a thickness ranging from 0.1 mm to 0.2 mm on the at least one end surface.

4. The method for sealing a solid wood floor with wax according to claim 1, wherein a temperature of the wax ranges from 90° C. to 110° C.

5. The method for sealing a solid wood floor with wax according to claim 1, wherein the wax is selected from the group consisting of a natural wax, a water-based wax, and a solid wax.

6. The method for sealing a solid wood floor with wax according to claim 1, wherein spraying the at least one end surface with wax comprises: spraying the two end surfaces with wax.

* * * * *